United States Patent [19]

Kishino et al.

[11] Patent Number: 4,841,194

[45] Date of Patent: Jun. 20, 1989

[54] FLUORESCENT DISPLAY DEVICE

[75] Inventors: Takao Kishino; Tadashi Mizohata, both of Mobara, Japan

[73] Assignee: Futaba Denshi Kogyo K.K., Mobara, Japan

[21] Appl. No.: 262,194

[22] Filed: Oct. 19, 1988

Related U.S. Application Data

[63] Continuation of Ser. No. 827,265, Feb. 7, 1986, abandoned.

[30] Foreign Application Priority Data

Feb. 19, 1985 [JP] Japan ..... 60-30898

[51] Int. Cl.[4] ..... H01J 63/06

[52] U.S. Cl. ..... 313/496; 313/497

[58] Field of Search ..... 313/496, 497, 519

[56] References Cited

U.S. PATENT DOCUMENTS

| | | | |
|---|---|---|---|
| 3,231,776 | 1/1966 | Britnell et al. | 313/517 |
| 3,426,248 | 2/1969 | Cistola | 313/498 X |
| 3,512,028 | 3/1970 | McNaney | 313/517 |
| 3,538,371 | 11/1970 | Lehrer et al. | 313/517 |
| 3,668,466 | 6/1972 | Shimada | 313/497 X |
| 4,004,186 | 1/1977 | Bylander | 313/497 X |
| 4,387,322 | 6/1983 | Nixon | 313/497 |
| 4,582,210 | 4/1986 | Morimoto et al. | 313/496 X |

FOREIGN PATENT DOCUMENTS

| | | | |
|---|---|---|---|
| 0032664 | 3/1977 | Japan | 313/497 |

OTHER PUBLICATIONS

"Materials and Techniques for Electron Tubes", by W. H. Kohl, Reinhold Publishing Corp., New York, N.Y., 1962, pp. 30–33.

*Primary Examiner*—Palmer C. DeMeo

*Attorney, Agent, or Firm*—Oblon, Fisher, Spivak, McClelland & Maier

[57] ABSTRACT

A fluorescent display device which is capable of effectively utilizing characteristics of reinforced glass to be constructed in a light-weight and thin manner and forming a substrate into a small thickness to facilitate the handling of the substrate during the device manufacturing process. The device includes a casing comprising a front member and a rear member each formed at least a part thereof of reinforced glass and a substrate formed separate from the casing and interposed or fixed between the front member and the rear member.

9 Claims, 3 Drawing Sheets

FLUORESCENT DISPLAY DEVICE

This application is a continuation of application Ser. No. 827,265, filed on 02/07/86, now abandoned.

BACKGROUND OF THE INVENTION

1. Field of the Invention

This invention relates to a fluorescent display device adapted to display letter, figure or the like in a large size, and more particularly to such a fluorescent display device which allows a casing to be formed of reinforced glass.

2. Description of the Prior Art

A fluorescent display device has been extensively used as a self-luminous type display device for a display panel for a desk calculator, a clock, an electrical appliance such as an audio system or the like, an automobile speedometer, or the like.

Such a conventional fluorescent display device is typically constructed in such a manner as shown in FIGURE 3. More particularly, in FIG. 3 which is an exploded perspective view showing a typical conventional fluorescent display device, reference numeral 1 designates a substrate made of glass or ceramic and formed with through-holes 4*a*. On the substrate 1 except the through-holes 4*a* are applied wirings 2 and a light-nonpermeable insulating material 4. On each of the through-holes 4a are laminatedly applied anode conductors 3 and lead terminals 7*a*.

Then, phosphors 5 respectively exhibiting desired luminous colors are laminated on the anode conductors 3 to form anode sections A. Further, the display device includes filamentary cathodes 8 stretched above the substrate 1 through support members 6 and control electrodes 9 arranged between the filamentary cathodes 8 and the substrate 1. Reference numeral 7 designates lead wires for supplying electricity to each of the electrodes and reference numeral 10 indicates a front cover member which comprises a front plate 10*a* and side plates 10*b* each formed of glass or the like and is hermetically bonded to the substrate 1 by means of low-melting frit glass to form a casing B. Reference numeral 11 designates an evacuation tube, through which the casing B is evacuated to high vacuum of about $1\times10^{-5}-1\times10^{-7}$ Torr. Thereafter, the evacuation tube is sealed to keep the casing at such high vacuum.

In the fluorescent display device constructed as described above, electrons emitted from the filamentary cathodes 8 are accelerated or controlled by the control electrodes 9 and impinged on the phosphors 5 to effect luminous display.

Recently, such a fluorescent display device has been increasingly large-sized in the light of a demand for a display device wherein various kinds of display segments are arranged to carry out complex luminous display, a graphic display device exhibiting multi-display function and the like. Also, in the fluorescent display device, the casing B is constantly applied thereto external force or atmospheric pressure, because the interior is kept at high vacuum as described above. More particularly, supposing that the fluorescent display device has external dimensions as large as, for example, size A4 (210 mm×297 mm) and the casing B is formed of sheet glass, a height $H_1$ of the front plate 10*a* and that $H_3$ of the substrate 1 each are required to be as large as about 10 mm in order to provide the casing B with strength sufficient to withstand atmospheric pressure P, as shown in FIG. 4. Further, the arrangement of the filamentary cathodes 8, grid electrodes 9 and the like in the casing B requires to ensure an internal space having a height $H_2$ of about 5 mm therein. This will cause the overall height H of the casing B to be as large as about 25 mm and the total weight of the front plate 10a and substrate 1 to be as much as about 1.5 kg.

In order to lighten such a problem, it has been proposed and partially practiced to reinforce sheet glass so that it may have sufficient flexural strength in spite of its small thickness. Such reinforcement of the glass has been generally carried out according to the following three processes. One is called a low temperature ion exchange method which is to dip sheet glass in a bath of molten alkali salt containing an alkali ion larger in ionic radius than that contained in the glass at a temperature below the transition point temperature of the glass to carry out the replacement between both alkali ions and then cool the glass to reinforce a surface of the glass due to the difference in volume between both alkali ions replaced. Another is called an air-cooled reinforcement method which is to reinforce sheet glass due to the difference in cooling temperature. The other is called a high temperature ion exchange method which is to replace an alkali ion contained in sheet glass with that having a smaller ionic radius and then cool it to reinforce a surface of the glass due to the difference in expansion coefficient between an interior thereof and the surface. However, only the low temperature ion exchange method has been practiced in view of the strength and deformation of sheet glass reinforced, and the like.

Sheet glass reinforced according to the above-described low temperature ion exchange method (hereinafter referred to as "chemical reinforcement method") has strength about six times as large as ordinary or unreinforced one with respect to flexural stress. However, it has an important disadvantage that the replaced alkali ion is diffused into the glass to cause a decrease in flexural strength.

FIGS. 5(*a*) and 5(*b*) each show the relationships between the number of times of a heat treatment repeatedly carried out on reinforced glass under certain conditions and its average breaking flexural stress (an average value of several samples). In FIG. 5(*a*), the dotted line 51 indicates reinforced glass subjected to a heat treatment at 525° C. for 10 minutes twice, 52 indicates one treated at 560° C. for 7 minutes twice, and the line 53 indicates unreinforced glass. In FIG. 5(*b*), the line 54 indicates reinforced glass treated at 500° C. for 10 minutes three times and six times, and the chain line 55 indicates one treated at 560° C. for 7 minutes twice and then at 525° C. for 10 minutes twice. As is apparent from FIG. 5, a heat treatment at a high temperature causes strength of reinforced glass to be highly reduced, as indicated by the line 52. However, heat treatment conditions as indicated by the line 54 provides reinforced glass with strength three times as large as sheet glass or more, resulting in it being put into practice.

The application of reinforced glass to the casing of the fluorescent display device will be considered with respect to the substrate 1 and the front plate 10*a*. The front cover member 10 is subjected to a heat treatment only during the coating of an external electrical field shielding film on the front plate 10*a*, after the printing of a sealing material on the front plate 10*a* and side plates 10*b*, during the assembling between the front plate 10*a* and the side plate 10*b*, and during the assembling between the front cover member 10 and the substrate 1. The heat treatments each are generally carried out at a temperature of 480°-520° C. for 5-10 minutes. Accordingly, reinforced glass is permitted to keep strength about 3.5 times as large as sheet glass even after the heat treatment.

Whereas, the substrate 1, when it is one having wirings of a large thickness deposited thereon, is required to be subjected to a heat treatment after the printing of the wirings 2 formed of Ag or the like, after the printing of the light-nonpermeable insulating material 4, after the printing of the anode conductors 4, after the printing of a sealing material on the front cover member 10 and after the printing of phosphors repeated depending upon kinds of the phosphors. The heat treatments are generally carried out at a temperature of 450°-600° C. for about 10 minutes. Accordingly, the use of reinforced glass for the substrate 1 is not significant because the heat treatment reduces its strength to substantially the same degree as unreinforced sheet glass. Also, even if the heat treatment characteristics of reinforced glass is improved to a degree sufficient to keep satisfied strength even after it is subjected to the heat treatment so that the substrate 1 of a substantially small thickness may be formed, it is impossible to avoid the deformation of the substrate 1 unless Young's modulus of the substrate is increased, resulting in non-uniformity of luminance. Thus, the substrate 1 is required to have a significantly large thickness. This causes the fluorescent display device to be hard to be handled during the manufacturing process even when the front cover member 10 is formed of reinforced glass, because the substrate 1 has large thickness and weight as described above. This becomes remarkable particularly for a large-sized fluorescent display device. Further, this has another disadvantage of causing any damage to often occur in the substrate due to cracking or the like during the heat treatment.

SUMMARY OF THE INVENTION

The present invention has been made in view of the foregoing disadvantage of the prior art.

Accordingly, it is an object of the present invention to provide a fluorescent display device which is capable of being large-sized in a light-weight and thin manner by permitting reinforced glass to exhibit its useful characteristics.

It is another object of the present invention to provide a fluorescent display device which is capable of significantly reducing the thickness of a substrate to facilitate the handling of the substrate during the manufacturing process.

In accordance with the present invention, there is provided a fluorescent display device comprising a casing kept at high vacuum, a substrate constituting a part of the casing and having phosphor-deposited anode conductors arranged thereon, cathodes stretched in the casing for emitting electrons therefrom and control electrodes for effecting the acceleration and/or control of electrons emitted from the cathodes and adapted to carry out display of letter, figure or the like. The casing comprises a front member constituting a display surface and a rear member constituting a rear surface. The front member and rear member each are at least partially formed of reinforced glass. The substrate is formed separate from the casing and is interposed or fixed between the front member and the rear member.

In the fluorescent display device of the present invention constructed as described above, the casing formed of reinforced glass bears external force applied thereto to prevent it from being applied to the substrate. Also, the present invention significantly decreases steps of a heat treatment of the casing.

BRIEF DESCRIPTION OF THE DRAWINGS

These and other objects and many of the attendant advantages of the present invention will be readily appreciated as the same becomes better understood by reference to the following description when considered in connection with the accompanying drawings, wherein:

FIG. 1(*b*) is a vertical sectional view showing a generic construction of the fluorescent display device shown in FIG. 1(*a*);

FIG. 2(*b*) is a vertical sectional view showing a further embodiment of a fluorescent display device according to the present invention;

DETAILED DESCRIPTION OF THE PREFERRED EMBODIMENTS

Now, a fluorescent display device according to the present invention will be described hereinafter with reference to the accompanying drawings.

Figure 1A:
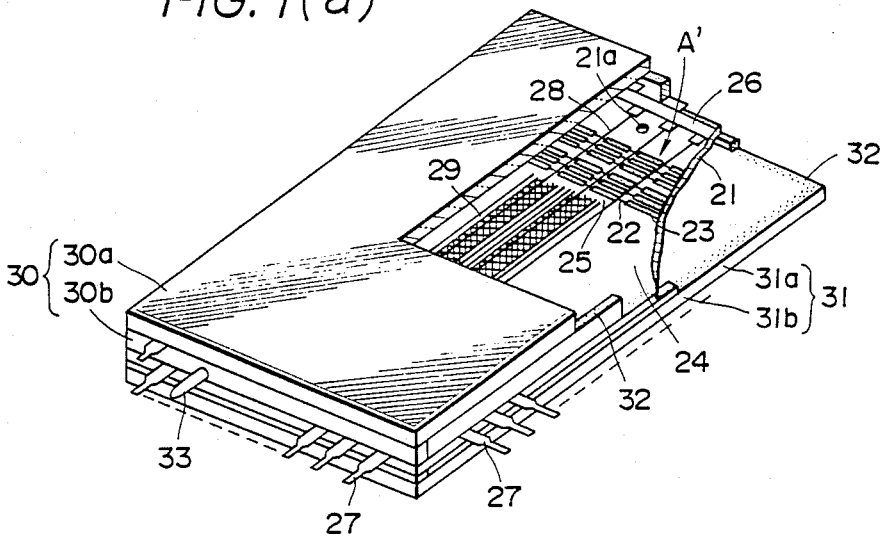
FIG. 1(*a*) is a partially cutaway perspective view showing an embodiment of a fluorescent display device according to the present invention.
Figure 1B:
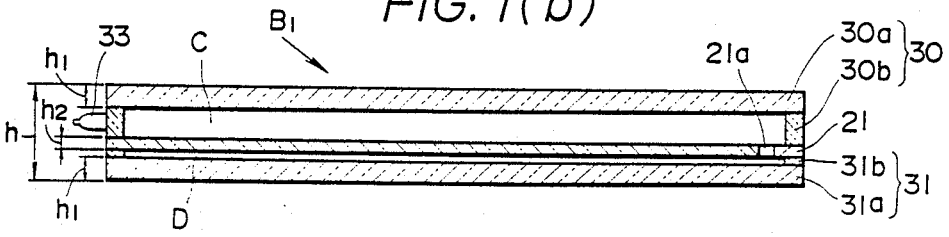

FIG. 1(*a*) shows an embodiment of a fluorescent display device according to the present invention and FIG. 1(*b*) shows a substrate and a casing in the fluorescent display device. In the illustrated embodiment, a substrate 21 is formed of sheet glass, on an upper surface of which wirings 22 and anode conductors 23 each formed by depositing and etching a conductive material such as Al or the like or screen-printing and calcining Ag paste or the like and phosphors 25 are laminated in order to form anode sections A'. A front plate designated by reference numeral 30a and described in detail hereinafter has support members 26 fixedly mounted on a lower surface thereof, between which filamentary cathodes 28 are stretchedly arranged to emit electrons therefrom. Reference number 29 designates control electrodes for effecting the acceleration and/or control of electrons emitted from the filamentary cathodes 28, as well as forming a display matrix in cooperation with the anode sections A' to effect what is called graphic display.

A casing $B_1$, as shown in FIG. 1(*b*), comprises a front member 30 constituting a display surface through which luminous display is observed and a rear member 31. The front member 30 comprises a front plate 30*a* formed of light-permeable glass reinforced according to the chemical reinforcement method and side plates 30*b* formed of sheet glass fixedly mounted on the front plate 30*a* by means of a sealing member 32 such as frit glass or the like. The rear member 31 likewise comprises a rear plate 31*a* formed of reinforced glass and side plated 31*b* formed of sheet glass which are bonded together by means of a sealing member 32. The above-described substrate 21 is fixedly interposed between the front member 30 and the rear member 31 through the sealing members 32, resulting in spaces C and D being defined between the front plate 30*a* and the substrate 21 and between the substrate 21 and the rear plate 31*a*, respectively. The casing $B_1$ thus formed is evacuated through an evacuation tube 33, which is then sealed to provide a fluorescent display device which has a sandwich construction and of which an interior is kept at high vacuum.

Figure 5A:
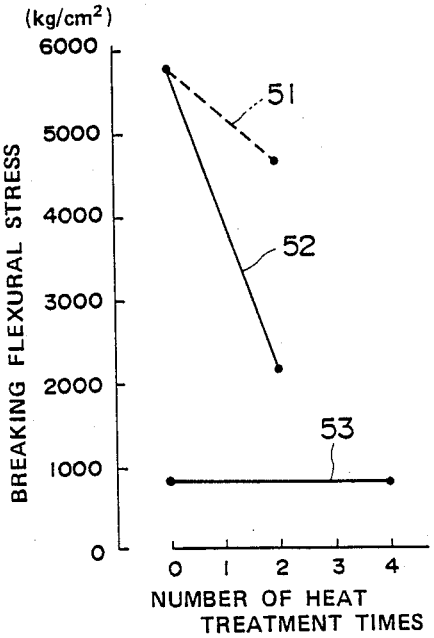
FIGS. 5(*a*) and 5(*b*) each are a graphical representation showing heat treatment characteristics of reinforced glass.
Figure 5B:
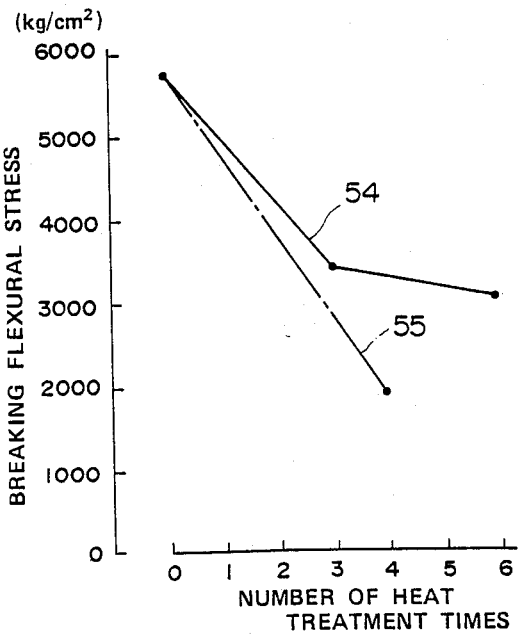

The space C described above is provided for arranging the filamentary cathodes 28, control electrodes 29 and the like therein, whereas the space D, when the rear plate 31*a* is deformed by external pressure, serves to absorb the deformation, to thereby prevent the deformed rear plate 31*a* from abutting against the substrate 21. The spaces C and D are communicated with each other via a through-hole 21*a* formed at the substrate 21, and they are kept at the same vacuum pressure. The substrate 21 and casing $B_1$ are prepared independent from each other, and both are assembled together in a final sealing process. Thus, the use of reinforced glass for the front plate 30*a* allows the glass to exhibit strength about 3.5 times as large as sheet glass as shown in FIGS. 5(*a*) and 5(*b*), because the front plate is subjected to only a heat treatment at a temperature of 480°-520° C. for 5-10 minutes three or four times or during the coating of an external electric field shielding film thereon, the application of the sealing material thereon, the assembling between the front plate 30a and the side plates 30*b*, the final assembling between the front member 30 and the substrate 21, and the like. Likewise, the rear plate 31*a* is subjected to a heat treatment under similar conditions so as to exhibit substantially the same strength as the front plate 30*a* even after the sealing step.

To the contrary, the substrate 21 is interposed in a sandwich-like manner between the front member 30 and the rear member 31 through the spaces C and D, and it is not substantially affected by external force mainly based on atmospheric pressure. Thus, although the conventional fluorescent display device requires to render the thickness of the substrate large to a degree sufficient to withstand atmospheric pressure because it constitutes a part of the casing as described above, the fluorescent display device of the illustrated embodiment permits the substrate to be formed into a significantly small thickness, as compared with that of the conventional one.

Also, the illustrated embodiment allows reinforced glass to be effectively used for the casing $B_1$. Accordingly, in the fluorescent display device having external dimensions as large as, for example, size A4 (210 mm×297 mm), the thickness $h_1$ of each of the front plate 30*a* and rear plate 31*a* and that $h_2$ of the substrate 21 are respectively set to be as small as about 6 mm and 3 mm, and the heights of the spaces C and D are respectively set to be as small as about 5 mm and 1 mm. This permits the overall height h of the fluorescent display device to be as small as about 21 mm. Such dimension is decreased by about 4 mm as compared with the height (about 25 mm) of the conventional casing formed of sheet glass. When, in the conventional casing, only the front plate is formed of reinforced glass, the overall height is substantially the same as the fluorescent display device of the illustrated embodiment. However, the thickness of the substrate 21 in the embodiment is only about one third as large as that in the conventional fluorescent device. Accordingly, the handling of the substrate in the device manufacturing process can be highly facilitated.

Also, the fluorescent display device of the illustrated embodiment decreases the difference in temperature between the interior and the surface during a heat treatment, to thereby effectively prevent damage of the substrate due to cracking or the like. Also, the spaces C and D are communicated with each other via the through-hole 21*a* to be kept at the same pressure, resulting in the deformation of the substrate due to the pressure difference therebetween being prevented. This permits the distance between the substrate 21 and the filamentary cathodes 28 to be kept constant. As a result, nonuniformity in brightness or luminance due to the deformation of the substrate can be effectively prevented.

The embodiment described above is constructed in the manner that the front member 30 and rear member 31 each comprise a plurality of the plate elements which are assembled together by means of the sealing member 32. However, the members each may be integrally formed.

Figure 2A:
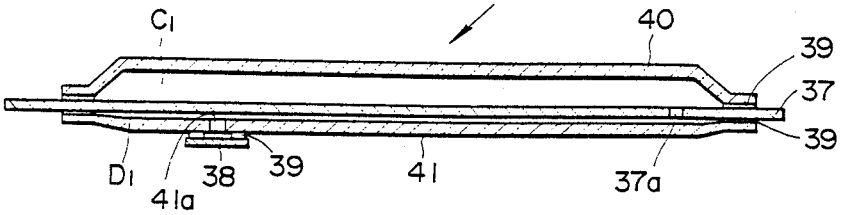
FIG. 2(*a*) is a vertical sectional view showing another embodiment of a fluorescent display device according to the present invention.
Figure 2B:
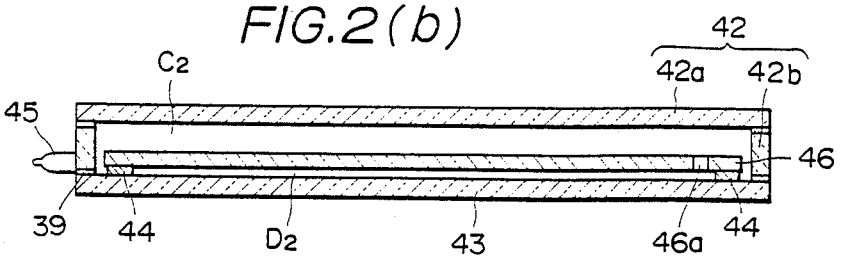
Figure 3:
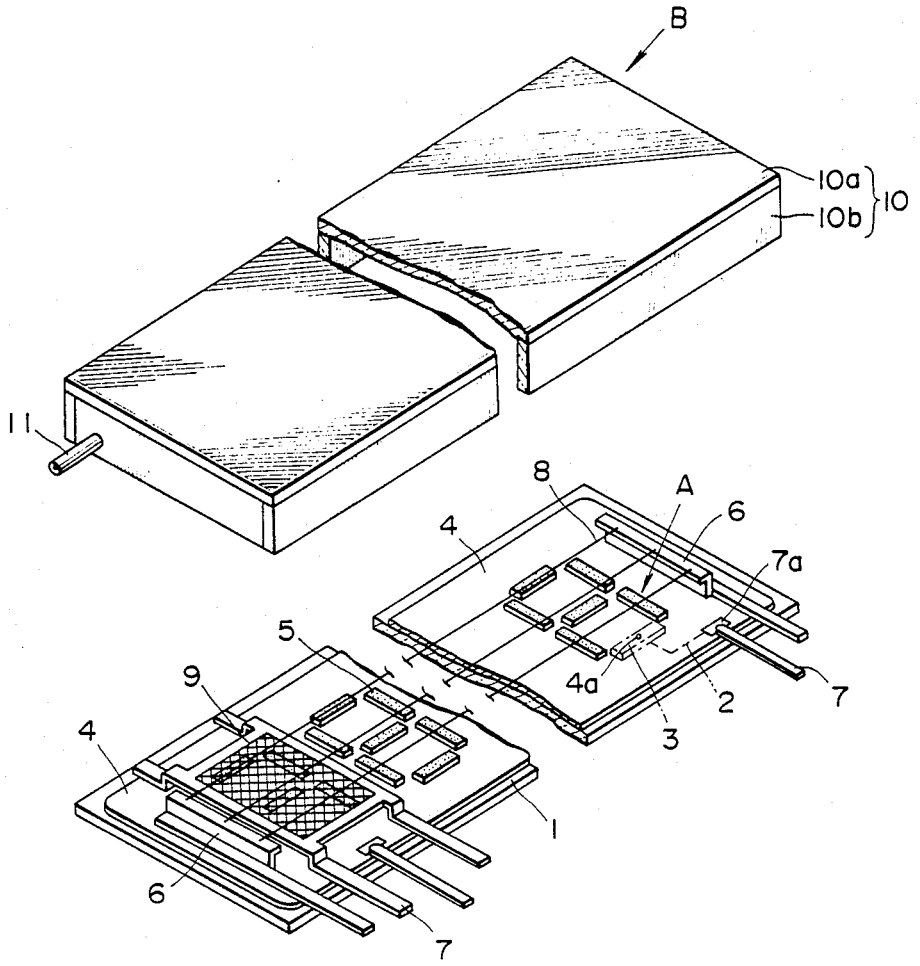
FIG. 3 is an exploded perspective view showing a conventional fluorescent display device.
Figure 4:
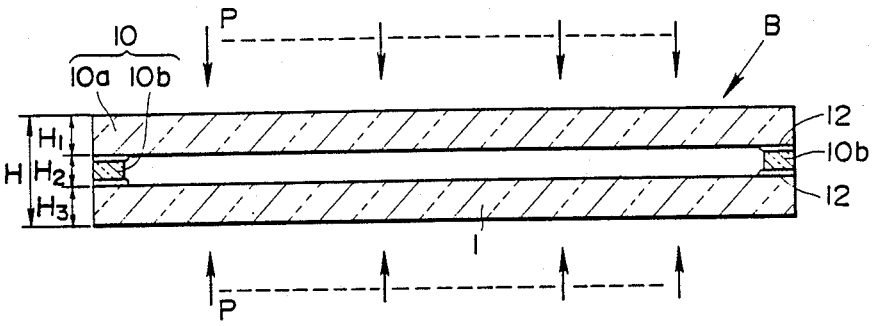
FIG. 4 is a vertical sectional view showing a casing for a conventional fluorescent display device.

FIG. 2(*a*) shows another embodiment of a fluorescent display device according to the present invention, wherein front member and rear member are each integrally formed. More particularly, a front member designated by reference numeral 40 is integrally formed by subjecting sheet glass to a suitable forming procedure such as hot-pressing or the like and then subjected to chemical reinforcement. Likewise, a rear member 41 is integrally formed and reinforced. The front member 40 and rear member 41 thus formed are fixed by means of a sealing member 39 with a substrate 37 being interposed therebetween, to thereby form a casing $B_2$ and define spaces $C_1$ and $D_1$ through the substrate 37 in the casing $B_2$.

The substrate 37 is arranged to outwardly project from the casing $B_2$, and wiring conductors (not shown) provided on the substrate 37 are led out directly to an exterior of the casing $B_2$ without using any lead wire. The substrate 37 is formed with a through-hole 37*a*, through which the spaces $C_1$ and $D_1$ are communicated together. Reference numeral 41*a* indicates an evacuation hole formed through the rear member 41, through which air is evacuated from the caing $B_2$. Then, the evacuation hole 41a is sealed with a lid member 38 by means of a sealing member 39, and the casing $B_2$ are kept at high vacuum.

In the embodiment illustrated in FIG. 2(*a*), the front member 40 and rear member 41 each are integrally formed. This results in both members being decreased in an opportunity subjected to a heat treatment as compared with front and rear members each assembled by means of a sealing member as in the embodiment shown in FIG. 1. Thus, characteristics of reinforced glass can be more effectively utilized.

In the embodiment shown in FIG. 2(*a*), the substrate is interposedly arranged between the front member and the rear member. However, the present invention is not limited to such construction.

FIG. 2(*b*) shows a further embodiment of a fluorescent display device according to the present invention, wherein a substrate is fixedly held on either a front member or a rear member. More particularly, a fluorescent display device of the illustrated embodiment includes a front member 42 comprising a front plate 42*a* formed of reinforced glass and side plates 42*b* formed of sheet glass fixedly mounted on the front plate 41*a* and a rear member 43 by means of a sealing member. One of the side plates 42*b* is provided with an evacuation tube 45 through which the fluorescent display device is evacuated. In this embodiment, a substrate 46 having anode conductors, phosphors and the like arranged thereon is fixed to the rear member 43 through support members 44 by means of a sealing member so as to define spaces $C_2$ and $D_2$ between the front member 42 and the substrate 46 and between the substrate 46 and the rear member 43, respectively. The substrate 46 is formed with a through-hole 46a through which the spaces $C_2$ and $D_2$ are communicated with each other to have the same pressure. The front member 42 and rear member 43 are fixed together by means of a sealing member 39.

The embodiments described above each are so constructed that the space is defined between the substrate and the rear member to prevent atmospheric pressure from being applied to the substrate. Alternatively, the substrate may be tightly and integrally bonded to the rear member by means of a sealing member. Such construction exhibits substantially the same effect as a substrate formed into a large thickness. Thus, it is effectively put in practice. Also, the embodiments each are adapted to allow luminous display to be observed through the front member. Alternatively, the present invention may be so constructed that the anode conductors and substrate are formed of a light-permeable material to permit luminous display to be viewed from the rear member side.

As can be seen from the foregoing, in the fluorescent display device of the present invention, the substrate is formed separate from the casing so that the substrate may be prevented from being exposed directly to external force or atmospheric pressure. This permits the substrate to be formed in a light-weight and thin manner and facilitates the handling of the substrate during the device manufacturing process. Also, such construction decreases the difference in temperature between the interior of the substrate and the surface thereof during a heat treatment, resulting in the damage of the substrate due to cracking or the like during the treatment being substantially prevented. Also, the present invention decreases an opportunity of subjecting the casing to a heat treatment and effectively utilizes characteristics of reinforced glass, to thereby provide a fluorescent display device of which the overall height and weight are significantly decreased. Such an advantage is remarkable particularly for a large-sized fluorescent display device.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed as new and desired to be secured by letters patent of the United States is:

1. A fluorescent display device comprising:

a casing containing an evacuated chamber;

a substrate disposed in said evacuated chamber, said substrate being formed of a thin layer of sheet glass;

at least one display section formed on said substrate, said display section having a plurality of segments each comprising anode conductors having a phosphor layer deposited on the surface thereof; and a cathode stretched above said substrate for emitting electrons to be impinged upon said phosphor layer;

wherein said casing comprises a front member for permitting external view of said segments and a rear member for forming a rear surface of said casing, said front member and said rear member being formed of a thin layer of limited-heat-treated reinforced glass having a strength of about 3.5 times that of sheet glass after formation of said casing, heat treatment of said glass being limited to that required at least for coating of an external electric field shielding film on said front member and assembling said front and rear members together to form said casing;

and wherein said substrate is disposed in said evacuated chamber maintaining spaces between said front member and said substrate and between said substrate and said rear member said spaces allowing deformation of the front member and rear member without touching said substrate so that said substrate is not subject to external forces, said substrate being thinner than said front member.

2. The fluorescent display device as defined in claim 1, wherein said front member comprises a front plate and side plates, said side plates being formed of sheet glass fixedly mounted on said front plate and said substrate so as to define the space between said front plate and said substrate.

3. The fluorescent display device as defined in claim 1 or 2, wherein said rear member comprises a rear plate and side plates, said side plates being formed of sheet glass fixedly mounted on said rear plate and said substrate so as to define the space between said rear plate and said substrate.

4. The fluorescent display device as defined in claim 1, wherein said substrate is extended outwardly projected from said casing.

5. The fluorescent display device as defined in claim 1, wherein said front member comprises a front plate and side plates, said side plates being formed of sheet glass fixedly mounted on said front plate and said rear member so as to define said evacuated chamber within said casing.

6. The fluorescent display device as defined in claim 5, wherein said substrate is fixed to said rear member through support member maintaining the space between said rear member and said substrate.

7. The fluorescent display device as defined in claim 1, wherein said substrate is provided with a through-hole for communicating with the spaces between said front member and said substrate and between said substrate and said rear member.

8. The fluorescent display device as defined in claim 1, wherein said substrate is about 3 mm thick .

9. The fluorescent display device as defined in claim 1, wherein said casing is about 21 mm thick.

* * * * *